US008575497B2

(12) United States Patent
Hultgreen

(10) Patent No.: US 8,575,497 B2
(45) Date of Patent: Nov. 5, 2013

(54) CONTROL CABINET ARRANGEMENT

(75) Inventor: Jerry Hultgreen, Krusaa (DK)

(73) Assignee: Danfoss A/S, Nordborg (DK)

( * ) Notice: Subject to any disclaimer, the term of this patent is extended or adjusted under 35 U.S.C. 154(b) by 263 days.

(21) Appl. No.: 13/122,049

(22) PCT Filed: Sep. 29, 2009

(86) PCT No.: PCT/DK2009/000214

§ 371 (c)(1),
(2), (4) Date: Apr. 25, 2011

(87) PCT Pub. No.: WO2010/037390

PCT Pub. Date: Apr. 8, 2010

(65) Prior Publication Data

US 2011/0186344 A1 Aug. 4, 2011

(30) Foreign Application Priority Data

Oct. 1, 2008 (DE) ..... 10 2008 049 864

(51) Int. Cl.
*H02G 3/12* (2006.01)

(52) U.S. Cl.
USPC ..... 174/502; 174/520; 174/50; 174/503; 248/906; 312/223.1

(58) Field of Classification Search
USPC ..... 174/50, 481, 480, 53, 57, 58, 520, 502, 174/503, 490, 504, 486, 487, 484; 248/200, 248/906, 27.1; 439/544, 535, 536, 949; 312/223.1
See application file for complete search history.

(56) References Cited

U.S. PATENT DOCUMENTS

| | | | | |
|---|---|---|---|---|
| 3,248,078 | A | 4/1966 | Ast | |
| 5,152,496 | A | 10/1992 | Kobayashi | |
| 5,302,139 | A * | 4/1994 | Starsja | 439/544 |
| 6,441,304 | B1 * | 8/2002 | Currier et al. | 174/53 |
| 6,717,050 | B2 * | 4/2004 | Laflamme et al. | 174/50 |
| 7,173,185 | B1 * | 2/2007 | Cloran et al. | 174/58 |
| 8,237,064 | B2 * | 8/2012 | Trolese et al. | 174/503 |

FOREIGN PATENT DOCUMENTS

| | | | |
|---|---|---|---|
| DE | 8708349 | U | 7/1987 |
| DE | 4100449 | A1 | 7/1991 |
| DE | 10236814 | A1 | 2/2004 |
| DE | 102007004017 | A1 | 7/2008 |
| DE | 102007004018 | A1 | 7/2008 |

(Continued)

OTHER PUBLICATIONS

International search report for PCT/DK2009/000214 dated Jul. 26, 2010.

*Primary Examiner* — Angel R Estrada
(74) *Attorney, Agent, or Firm* — McCormick, Paulding & Huber LLP

(57) ABSTRACT

The invention concerns a control cabinet arrangement (1) with a control cabinet (2), a mounting plate (6) having a front face (14), a rear face (13) and an opening (8), in which the control cabinet (2) is arranged, a frame and a retainer device. The invention is based on the task of providing a simple assembly of a control cabinet arrangement. For this purpose, the retainer device comprises several bolts (16) abutting the rear face (13) of the mounting plate (6), at least one bolt (16) being displaced into a spacing on the rear face (13) of the mounting plate (6) by the interaction of the control cabinet (2) and the frame (7).

14 Claims, 3 Drawing Sheets

(56) References Cited

FOREIGN PATENT DOCUMENTS

| | | | |
|---|---|---|---|
| DE | 102007004020 | A1 | 7/2008 |
| DE | 102007004021 | A1 | 7/2008 |
| GB | 2153427 | A | 8/1985 |
| WO | 03081153 | A1 | 10/2003 |

* cited by examiner

Fig.1
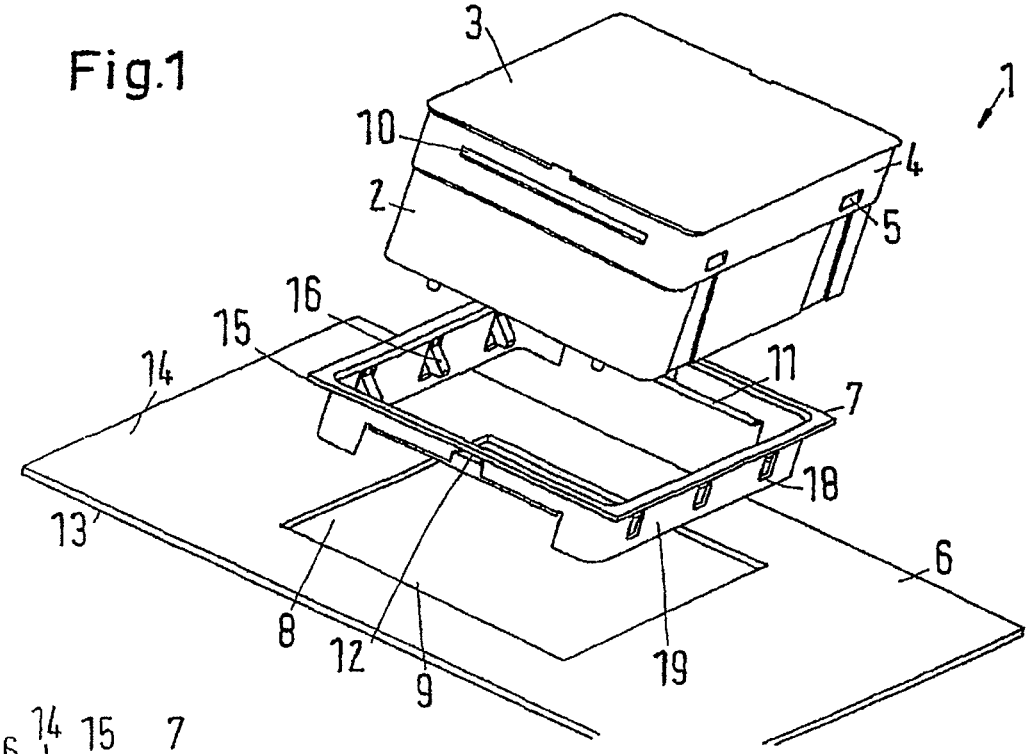
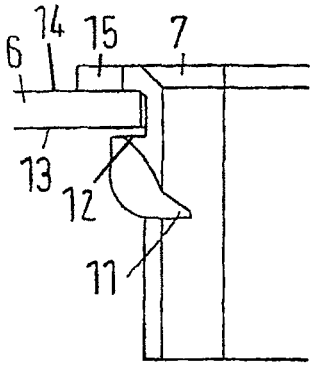
Fig.3
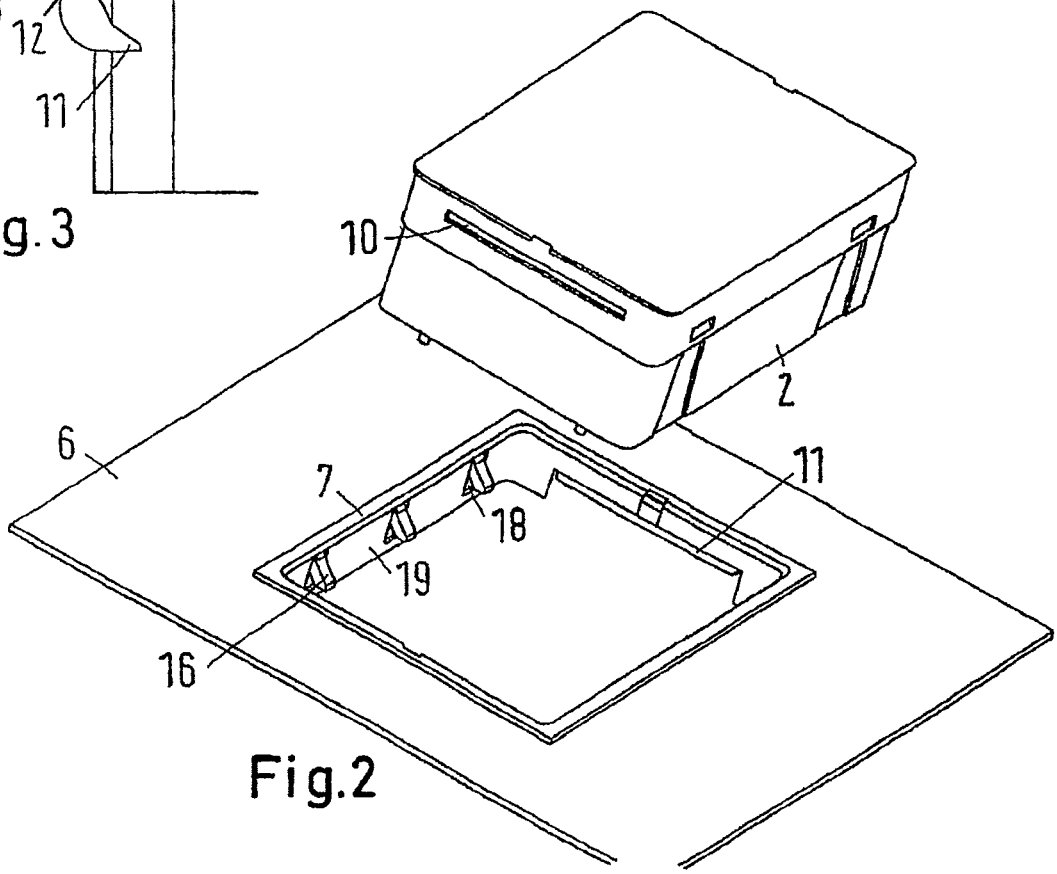
Fig.2

Fig.5
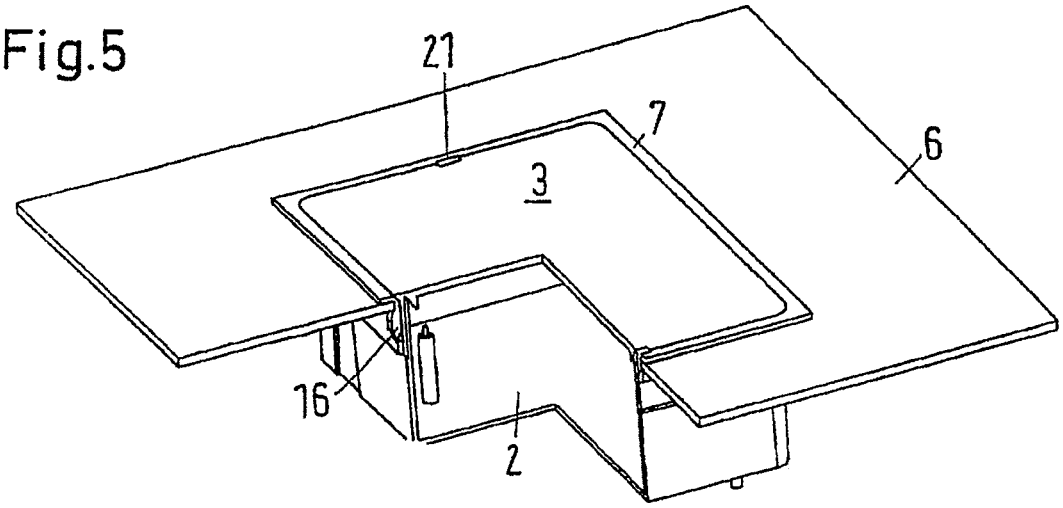
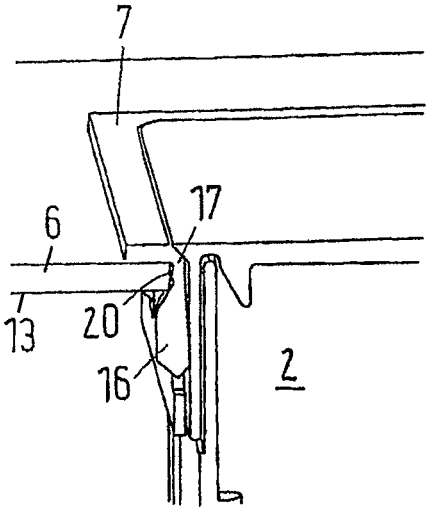
Fig.6
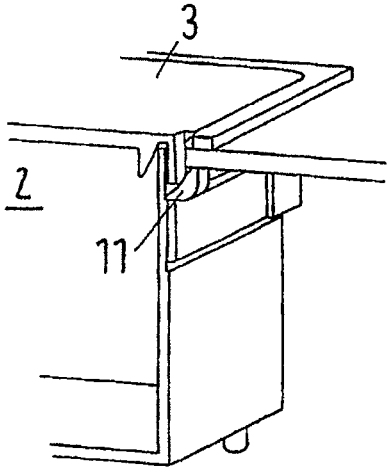
Fig.4
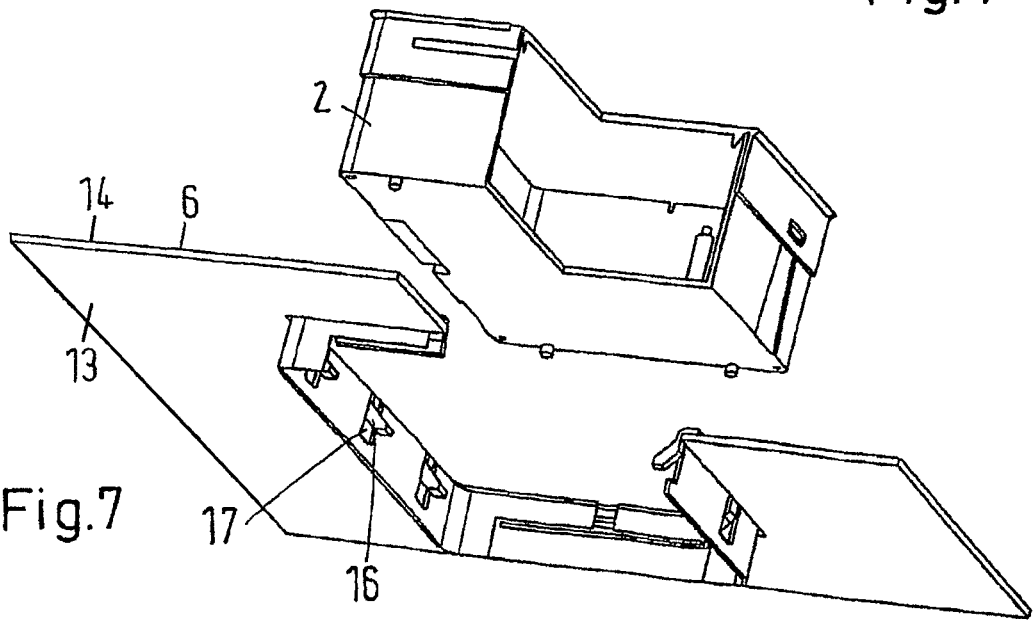
Fig.7

CONTROL CABINET ARRANGEMENT

CROSS REFERENCE TO RELATED APPLICATIONS

This application is entitled to the benefit of and incorporates by reference essential subject matter disclosed in International Patent Application No. PCT/DK2009/000214 filed on Sep. 29, 2009 and German Patent Application No. 10 2008 049 864.5 filed on Oct. 1, 2008.

FIELD OF THE INVENTION

The invention relates to a control cabinet arrangement with a control cabinet, a mounting plate having a front face, a rear face and an opening, in which the control cabinet is arranged, a frame and a retainer device.

BACKGROUND OF THE INVENTION

Such a control cabinet arrangement is known from WO 03/081153 A1. The known control cabinet arrangement is used in household appliances, for example in a refrigerator with the purpose of adjusting refrigerator functions. In the known case, the mounting plate is formed by the front of the refrigerator door or a plate at the front of the refrigerator. For fixing the control cabinet, a rear face cover is located at the rear face of the mounting plate. Subsequently, polyurethane is pumped into the spacing on the rear face in order to fix the rear face cover. Then the control cabinet is inserted and retained in the rear face cover by mounting the frame. Such an assembly is troublesome and requires a plurality of units. Further, the opening in the mounting plate has a relatively complicated contour. The rear face of the mounting plate must be accessible for the mounting of the rear face cover.

SUMMARY OF THE INVENTION

The invention is based on the task of providing a simple assembly of a control cabinet arrangement.

With a control cabinet as mentioned in the introduction, this task is solved in that the retainer device comprises several bolts abutting on the rear face of the mounting plate, at least one bolt being displaced into a spacing on the rear face of the mounting plate by the interaction of the control cabinet and the frame.

The assembly of such a control cabinet arrangement merely requires access to the front face of the mounting plate. It is then possible to insert the control cabinet and the frame into the opening from the front face, the insertion triggering a movement of at least one bolt, which will then be displaced behind the mounting plate. Thus, the bolt will form a form-fitting connection with the mounting plate, without requiring access to the rear face of the mounting plate. As the control cabinet and the frame have to be inserted into the mounting plate anyway, additional assembly steps for fixing the control cabinet in the mounting plate are not required. In a manner of speaking, the fixing appears during insertion. Also additional fixing elements, such as screws or nuts, are not required. Tools are not required for the assembly either.

Preferably the control cabinet and the frame are connected to one another by means of a latch connection. The latch connection prevents an unintentional separation of the control cabinet and the frame. Such a separation could influence the fixing of the control cabinet in the mounting plate. The latch connection can, of course, be detached by applying external forces. During normal operation, however, such forces should not be feared. This is particularly the case, when the control cabinet arrangement is used with household appliances, for example a refrigerator, a washing machine, a laundry drier, a cooker, a cooker hood, an ironing machine or the like, in which the control cabinet is only required for the adjustment of functions. The latch connection is dimensioned so that it can adopt forces appearing during adjustment work without problems.

Preferably, the bolt engages the mounting plate at the edge of the opening. Thus, the bolt does not only rest on the rear face of the mounting plate. The bolt, or an element connected to it, also engages the front face of the mounting plate. In a manner of speaking, the mounting plate is thus jammed between the combination of control cabinet and frame. This results in a good fixing of the control cabinet in the mounting plate.

Preferably, in the area of the edge, the bolt has a curvature on the side facing the edge. This enables the bolt to engage differently thick mounting plates. The mounting plate projects into the curvature. In this connection, it is favourable for the bolt to have a certain flexibility, at least in the area of the curvature. However, this flexibility should only be large enough to accommodate different thicknesses of the mounting plate, not, however, to influence the fixing of the control cabinet in the mounting plate.

Preferably, in relation to the thickness of the mounting plate between the front face and the rear face, the bolt has a retaining dimension, and the mounting plate has a thickness that corresponds to the retaining dimension ±35%. The design of the bolt engaging the mounting plate at the edge of the opening thus makes it possible to use differently thick mounting plates. Accordingly, a control cabinet arrangement can be used for different purposes.

Preferably, the bolt has a tolerance compensation that amounts to up to 1 mm. Accordingly, the dimensions of the opening, into which the control cabinet and the frame are inserted, can deviate by up to ±0.5 mm from a nominal size without influencing the insertion of the control cabinet into the mounting plate. The tolerance compensation depends on the size of the control cabinet. With smaller control cabinets, the overall tolerances are smaller.

In a preferred embodiment, it is provided that the bolt is arranged on the frame and displaced to the rear face of the mounting plate by the control cabinet. In this case, the frame is mounted on the control plate first. In the simplest case, this is done in that the frame is inserted into the opening of the mounting plate. When the control cabinet has then been inserted into the frame, the bolt or bolts are outwardly displaced in relation to the frame, so that they reach the spacing on the rear face of the mounting plate to form a form-fitting connection with the mounting plate.

Preferably, at least in the area of the bolt, the frame rests on the front face of the mounting plate. Thus, the frame forms the part of the corresponding bolt that engages the mounting plate in the area of the edge of the opening. Additional measures are not required.

In an alternative embodiment, it is provided that the bolt is arranged at the control cabinet and displaced to the rear face of the mounting plate by the frame. In this case, the mounting takes place in the opposite order. First the control cabinet and then the frame are inserted into the opening, the frame displacing the bolt away from the control cabinet and into the spacing on the rear face of the mounting plate.

Preferably, the bolt has a projection on the side facing the control cabinet. This provides a force or movement ratio, that is, the projection can be used to displace the bolt by a sufficient path into the spacing on the rear face of the mounting plate.

It is particularly preferred that the frame has an inclined face interacting with the projection. This facilitates the mounting. It is also possible not to form the inclination until the bolt with its projection presses against the frame.

Preferably, the bolt is biased in the direction of the control cabinet. Thus, when (in the one embodiment) the control cabinet or (in the other embodiment) the frame is pulled out of the mounting plate, the bolt or bolts spring back, so that the control cabinet and/or the frame is released from the mounting plate and can be removed again without problems.

Preferably, the control cabinet has an at least partially transparent cover that is located at a front face of the control cabinet and extends with a side wall section at least partly to at least one side wall, the side wall section acting upon the bolt. Thus, the cover of the control cabinet is jammed on the control cabinet itself by the bolt, so that the durability of the cover of the control cabinet is improved.

Preferably, the frame has a catch arrangement that engages the mounting plate. In particular when the frame is mounted on the mounting plate first, this embodiment has the advantage that the frame can be temporarily connected to the mounting plate. This facilitates the handling. After insertion of the frame into the opening of the mounting plate, the installer has both hands free again for the subsequent mounting of the control cabinet, without risking that the frame falls out of the mounting plate.

BRIEF DESCRIPTION OF THE DRAWINGS

In the following, the invention is described on the basis of preferred embodiments in connection with the drawings, showing:

FIG. 1 is a first embodiment of a control cabinet arrangement in a perspective, exploded view, FIG. 2 shows the control cabinet arrangement with a frame inserted into a mounting plate, FIG. 3 is an enlarged view of a part of FIG. 2 in a section, FIG. 4 is a view according to FIG. 3 with inserted control cabinet, FIG. 5 shows the control cabinet arrangement in a perspective view in the mounted state, FIG. 6 is a section enlargement from FIG. 5, FIG. 7 shows the control cabinet arrangement according to FIG. 2 from another view angle.

DETAILED DESCRIPTION OF THE PREFERRED EMBODIMENT

Figure 8:
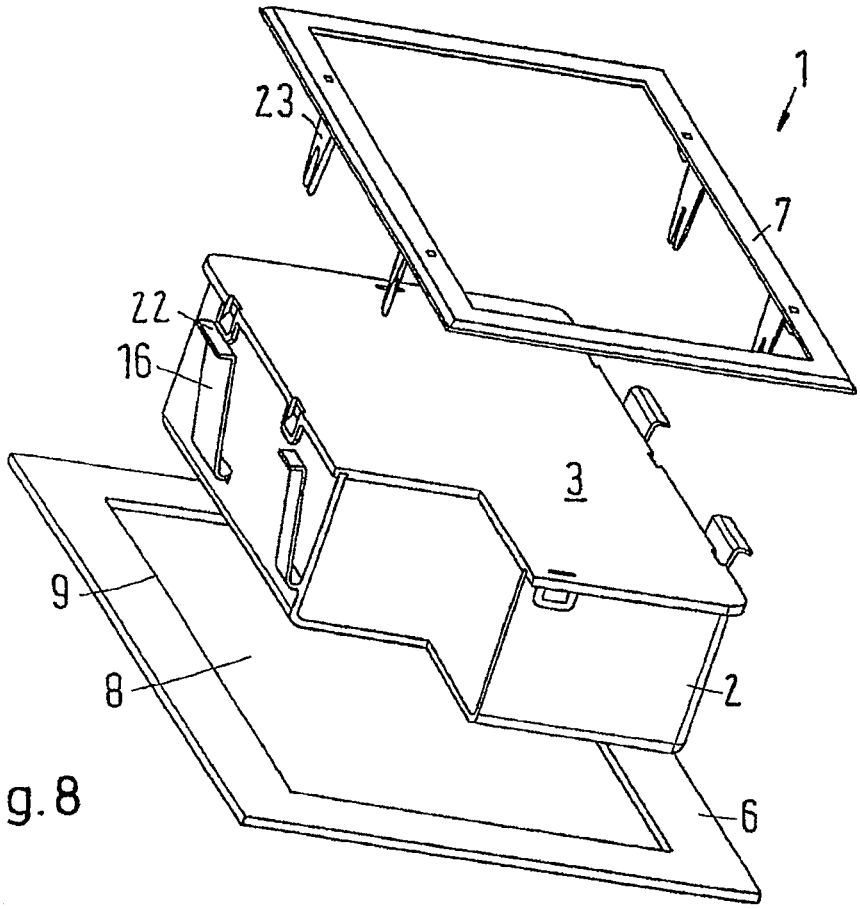
FIG. 8 is a second embodiment of a control cabinet arrangement in a perspective, exploded view.

A control cabinet arrangement 1 comprises a control cabinet 2 that is provided with a transparent cover 3. The transparent cover 3 (that does not have to be transparent all over) comprises a side wall section 4 that is led over a side wall of the control cabinet 2. The cover 3 is connected to the control cabinet 2 at fixing points 5.

In the following, the invention is described on the basis of applying the control cabinet arrangement 1 in connection with a refrigerator. For this purpose, the control cabinet 2 comprises a control electronic for the refrigerator and a display that can be seen through the transparent cover 3. Further, the control cabinet 2 can also comprise operating elements, for example in the form of keys or the like, which can be activated through the transparent cover 3. For reasons of clarity, a cable connecting the control cabinet 2 to other elements of the refrigerator is not shown.

The control cabinet 2 is to be mounted in a mounting plate 6. The mounting plate 6 forms, for example, the front face of a refrigerator door or the front face of a refrigerator housing. Thus, the mounting plate 6 can also be called "chassis".

The control cabinet arrangement 1 also comprises a frame 7. In the embodiments according to the FIGS. 1 to 7, the frame 7 is located between the control cabinet 2 and the mounting plate 6, when the control cabinet 2 is built into the mounting plate 6.

For the accommodation of the control cabinet 2 and the frame 7, the mounting plate 6 has an opening 8. The opening 8 is surrounded by an edge 9. The opening 8 can simply have a rectangular shape or another shape adapted to the control cabinet 2. Otherwise, a working of the mounting plate 6 is not required.

In the side wall section 4 of the cover 3, the control cabinet 2 comprises a groove 10. Only one groove 10 is visible. On the opposite side of the control cabinet 2 a corresponding groove is available. The frame 7 comprises a catch projection 11 that engages the groove 10, when the control cabinet 2 is inserted into the frame 7. The interaction of the catch projection 11 and the groove 10 forms a catch connection that can resist the forces usually appearing during normal operation.

The frame 7 comprises a catch 12 that engages behind a rear face 13 of the mounting plate 6. On the opposite front face 14 of the mounting plate 6 the frame 7 rests on a circumferential bearing face 15. The catch 12 can be led past the mounting plate 6, as the frame 7 has a sufficient flexibility. When inserting the frame 7 into the opening 8 of the mounting plate 6, the side of the frame comprising the catch 12 will be inwardly deformed, and can then spring back again.

Further, the frame 7 has several bolts 16 that are connected to the frame 7 via a flexible support 17. Due to the support 17, the bolts 16 are biased in the direction of the inside of the frame 7, that is, in the direction of the eventual location of the control cabinet 2. The bolts 16 can be pressed through openings 18 in a side wall 19 of the frame 7, when the control cabinet 2 is inserted into the frame 7.

In the area of the support 17, the bolt 16 has an curvature, in which the mounting plate 6 engages, when the bolt 16 has been moved in a spacing on the rear face 13 of the mounting plate 6 by the control cabinet 2. The curvature 20 makes it possible to use the same frame 7 with different mounting plates 6, whose thicknesses differ. The bolts are, for example, provided for a certain thickness of the plate 6, in the following called "retaining dimension". The bolts 16 can, however, also provide a sufficiently stable connection between the frame 7 and the mounting plate 6, when the thickness of the plate is up to 35% larger or smaller than this retaining dimension.

The fact that the supports 17 of the bolts 16 are made with a certain flexibility causes that the opening 8 does not have to be manufactured with an excessively large accuracy. Both in the length and in the width the opening 8 can have a tolerance in the order of up to ±0.5 mm, depending on the size of the control cabinet.

The mounting of the control cabinet 2 with the embodiment shown in the FIGS. 1 to 7 now takes place as follows:

First, the frame 7 is inserted into the opening 8, until the bearing face 15 rests on the front face 14 of the mounting plate 6. The catch 12 engages behind the rear face 13 of the mounting plate. Thus, the frame 7 is temporarily fixed to the mounting plate 6.

In this embodiment, the control cabinet 2 is then inserted into the frame 7. The control cabinet 2 then comes to rest on the inwardly projecting bolts 16 and presses them towards the outside through the openings 18 in the wall 19, so that the bolts 16 engage under the rear face 13 of the mounting plate 6. In this connection, the bolts 16 only bear on the side wall of the control cabinet 2. Thus, it is not necessary in any way to locate the bolts behind the bottom of the control cabinet 2. Thus, it is possible to use control cabinets 2 with different heights.

When the control cabinet 2 has been inserted far enough into the frame 7, the catch projection 11 on the frame 7 will engage the groove 10 on the control cabinet 2, so that the control cabinet 2 interlocks with the frame 7. The control cabinet 2 is then held captive in the frame 7 and continuously holds the bolt 16 in the position shown in FIG. 6, so that the frame 7 cannot be removed from the mounting plate 6.

Figure 9:
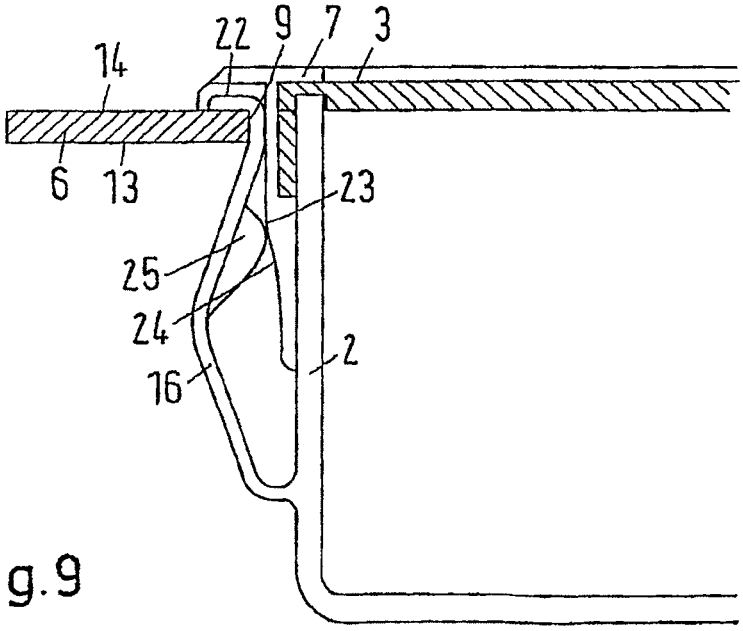
FIG. 9 is a sectional view of the control cabinet arrangement according to FIG. 8.

A further embodiment is shown in the FIGS. 8 and 9. Here, the same elements have the same reference numbers as in the FIGS. 1 to 7.

In this embodiment, the bolts 16 are located at the control cabinet 2. On their upper ends, the bolts 16 have a connector 22. In this embodiment, first the control cabinet 2 is inserted into the opening 8 of the mounting plate 6. In this connection, the connectors 22 of the bolts 16 rest on the front face 14 of the mounting plate 6. In a horizontal position of the mounting plate 6, a provisional positioning of the control cabinet 2 in relation to the mounting plate 6 is ensured.

Subsequently, the frame 7 is inserted into a gap between the control cabinet 1 and the mounting plate 6. The frame 7 has a number of projections 23 corresponding to the number of bolts 16. These projections 23 are provided with inclined faces 24. The bolt 16 has a projection 25 in the direction away from the edge 9 of the opening 8, the inclined face 24 resting on said projection 25. This means that, when the frame 7 has been mounted on the mounting plate 6 and the projections 23 interact with the bolts 16, the inclined face 24 presses the projection 25 towards the outside, so that the bolt 16 again engages the rear face 13 of the mounting plate 6. Also with this embodiment, the control cabinet 2 is held in the mounting plate 6 with sufficient stability.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A control cabinet arrangement comprising:

a control cabinet;

a mounting plate having a front face, a rear face and an opening in which the control cabinet is arranged;

a frame; and a retainer device;

wherein the retainer device comprises at least one bolt configured to be displaced to abut the rear face of the mounting plate by the interaction of the control cabinet and the frame;

wherein the interaction of the control cabinet and the frame comprises the frame being inserted into the opening of the mounting plate, and the control cabinet being inserted into the frame, and the control cabinet resting on the at least one bolt.

2. The control cabinet arrangement according to claim 1, wherein the control cabinet and the frame are connected to one another by means of a latch connection.

3. The control cabinet arrangement according to claim 1, wherein the bolt engages the mounting plate at the edge of the opening.

4. The control cabinet arrangement according to claim 3, wherein the area of the edge, the bolt has a curvature on the side facing the edge.

5. The control cabinet arrangement according to claim 3, wherein relation to the thickness of the mounting plate between the front face and the rear face, the bolt has a retaining dimension, and the mounting plate has a thickness that corresponds to the retaining dimension ±35%.

6. The control cabinet arrangement according to claim 1, wherein the bolt has a tolerance compensation that amounts to up to ±0.5 mm.

7. The control cabinet arrangement according to claim 1, wherein the bolt is arranged on the frame and displaced to the rear face of the mounting plate by the control cabinet.

8. The control cabinet arrangement according to claim 7, wherein at least in the area of the bolt, the frame rests on the front face of the mounting plate.

9. The control cabinet arrangement according to claim 1, wherein the bolt is arranged at the control cabinet and displaced to the rear face of the mounting plate by the frame.

10. The control cabinet arrangement according to claim 9, wherein the bolt has a projection on the side facing the control cabinet.

11. The control cabinet arrangement according to claim 10, wherein the frame has an inclined face interacting with the projection.

12. The control cabinet arrangement according to claim 1, wherein the bolt is biased in the direction of the control cabinet.

13. The control cabinet arrangement according to claim 1, wherein the control cabinet has an at least partially transparent cover that is located at a front face of the control cabinet and extends with a side wall section at least partly to at least one side wall, the side wall section acting upon the bolt.

14. The control cabinet arrangement according to claim 1, wherein the frame has a catch arrangement that engages the mounting plate.

* * * * *